US006027390A

United States Patent [19]

Koizumi et al.

[11] Patent Number: 6,027,390

[45] Date of Patent: Feb. 22, 2000

[54] FRIT-SEALING APPARATUS FOR CATHODE-RAY TUBE

[75] Inventors: Hiroshi Koizumi; Hiroshi Okuda, both of Tokyo, Japan

[73] Assignee: Mitsubishi Denki Kabushiki Kaisha, Tokyo, Japan

[21] Appl. No.: 09/001,008

[22] Filed: Dec. 30, 1997

[30] Foreign Application Priority Data

Jun. 5, 1997 [JP] Japan ..... 9-147430

[51] Int. Cl.[7] ..... H01J 9/26

[52] U.S. Cl. ..... 445/45; 445/73; 384/38

[58] Field of Search ..... 445/45, 73; 384/38

[56] References Cited

U.S. PATENT DOCUMENTS 3,739,632 6/1973 Miller et al. ..... 73/162

4,995,734 2/1991 Schroeder ..... 384/38

5,145,511 9/1992 Patel et al. ..... 445/45

FOREIGN PATENT DOCUMENTS 7-37502 2/1995 Japan .

7-73803 3/1995 Japan .

*Primary Examiner*—Kenneth J. Ramsey

[57] ABSTRACT

A frit-sealing apparatus for a cathode-ray tube has a nozzle portion being inserted into and withdrawn later from the cathode-ray tube supported in a certain position; a guide block for supporting the nozzle portion; a guide rod for supporting the guide block so as to slide in directions in which the nozzle portion is inserted and withdrawn; and a rotation restriction member being in contact with an outer surface of the guide block, thereby restricting rotation of the guide block.

11 Claims, 9 Drawing Sheets

FRIT-SEALING APPARATUS FOR CATHODE-RAY TUBE

BACKGROUND OF THE INVENTION

The present invention relates to a frit-sealing apparatus for a cathode-ray tube, which is used when a panel and a funnel constituting the cathode-ray tube are joined by fusing frit glass.

FIG. 13 is a schematic illustration of the configuration of a conventional frit-sealing apparatus for a cathode-ray tube, with parts partially broken away. FIG. 14 is a sectional view taken along the line $S_{14}$—$S_{14}$ of FIG. 13.

As shown in FIG. 13 and FIG. 14, when the conventional frit-sealing apparatus for a cathode-ray tube is used to join the panel and the funnel 2 by fusing frit glass in a frit seal furnace (not shown), the nozzle portion 10 for letting air flow back from the cathode-ray tube is inserted into the funnel 2 (the inserted position is indicated by the solid line in FIG. 13) and then withdrawn (the withdrawn position is indicated by the broken line in FIG. 13) in such a manner that the nozzle 10 does not touch the neck portion 2*a* of the funnel 2.

The nozzle portion 10 is inserted and withdrawn by moving the guide block 31 supporting the nozzle portion 10 along the guide rod 32 in the directions A. The guide block 31 and the guide rod 32 each have a keyway. The key member 33 is fitted to the keyway formed on the guide block 31. The key member 33 is also fitted to the keyway formed on the guide rod 32 so as to slide along the keyway. The key member 33 has a function to prevent the guide block 31 from rotating on the guide rod 32.

However, while the conventional frit-sealing apparatus for a cathode-ray tube is traveling in the heated frit seal furnace, the guide rod 32 may be heat-distorted to warp or the guide rod 32 or key member 33 may be expanded by heat to make the guide rod 32 and the guide block 31 jammed. This makes it impossible to lower the guide block 31. Because the nozzle portion 10 can not be withdrawn, the cathode-ray tube can not be removed.

Dust originating from the chain of a carrying mesh belt in the frit seal furnace or the like or soot formed by incomplete combustion of a radiant tube or the like may be deposited on the keyway of the guide rod 32, making the key member 33 jammed in the keyway of the guide rod 32. This makes it impossible to lower the guide block 31. Because the nozzle portion 10 cannot be withdrawn, the cathode-ray tube can not be removed.

If a cathode-ray tube cannot be removed while a plurality of cathode-ray tubes are conveyed in order on the carrying mesh belt, the mesh belt stops, leaving some cathode-ray tubes overheated for a long time in the frit seal furnace. This results in thermal plastic deformation of the panel, the funnel and the mask frame for color selection, significantly degrading the product quality of the cathode-ray tube.

SUMMARY OF THE INVENTION

It is an object of the present invention to provide a frit-sealing apparatus for a cathode-ray tube that can ensure smooth insertion and withdrawal of the nozzle portion regardless of the temperature, foreign substances, and other environmental conditions.

According to one aspect of the present invention, a frit-sealing apparatus for a cathode-ray tube has a nozzle portion being inserted into and withdrawn later from the cathode-ray tube supported in a certain position; a guide block for supporting the nozzle portion; a guide rod for supporting the guide block so as to slide in directions in which the nozzle portion is inserted and withdrawn; and a rotation restriction member being in contact with an outer surface of the guide block, thereby restricting rotation of the guide block.

Further, the frit-sealing apparatus for a cathode-ray tube may be constructed in such a way that an end portion of the guide rod, closer to the cathode-ray tube, is secured on a main body of the frit-sealing apparatus, another end portion of the guide rod, far from the cathode-ray tube, is secured on the rotation restriction member, and the rotation restriction member is provided to slide in the directions of insertion and withdrawal.

Furthermore, The frit-sealing apparatus for a cathode-ray tube may further have a first annular member having a shape of a ring with a first inner surface, which is in contact with the guide rod, and a first outer surface, which has a form of a part of a spherical surface, and a second annular member, which has a shape of a ring with a second inner surface in contact with the guide rod, and a second outer surface, which has a form of a part of a spherical surface, wherein the guide block has a through hole, through which the guide rod passes, a first bearing portion, which has a first concave surface having the same curvature as the first outer surface of the first annular member, which is provided in the through hole, and a second bearing portion, which has a second concave surface having the same curvature as the second outer surface of the second annular member, which is provided in the through hole, and wherein the first annular member is fitted to the first bearing portion in such a way that a central axis of the first annular member is able to be tilted from the central axis of the through hole, the second annular member is fitted to the second bearing portion in such a way that a central axis of the second annular member is able to be tilted from the central axis of the through hole, and the guide block and the nozzle portion are structured to slide along the guide rod by sliding the first inner surface of the first annular member and the second inner surface of the second annular member along the guide rod.

Also, the frit-sealing apparatus for a cathode-ray tube may further have an extensible cover for isolating the guide rod from external atmosphere. Further, the cover may have a metallic bellows structure. In addition, the cover may have a hole, through which air passes, and a filter provided in the hole for preventing foreign substances from entering through the hole.

According to another aspect of the present invention, a frit-sealing apparatus for a cathode-ray tube has: a nozzle portion being inserted into and withdrawn later from the cathode-ray tube supported in a certain position; a guide block for supports the nozzle portion; a guide rod for supporting the guide block so as to slide in directions in which the nozzle portion is inserted and withdrawn; and an extensible cover for isolating the guide rod from external atmosphere.

Further, the cover may have a metallic bellows structure. In addition, the cover may have a hole, through which air passes, and a filter provided in the hole for preventing foreign substances from entering through the hole.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

First Embodiment

Figure 1:
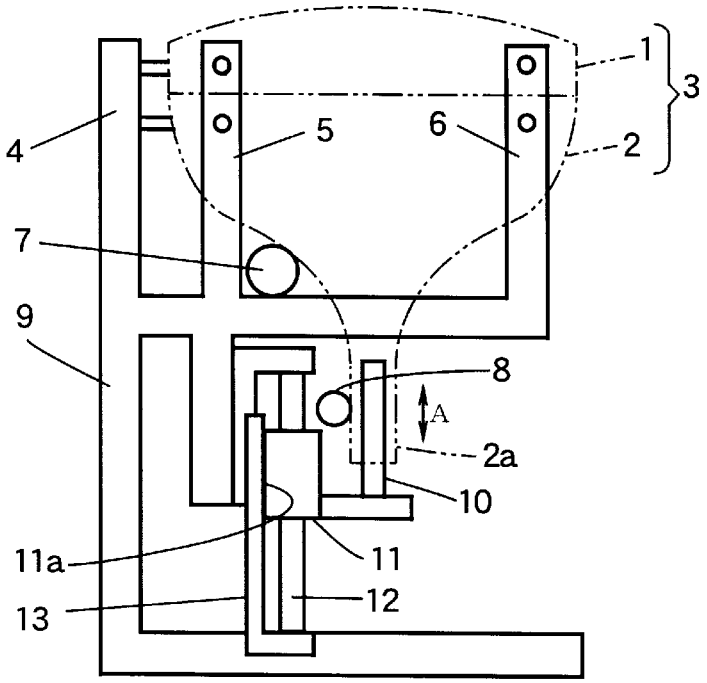
FIG. 1 is a schematic illustration of the configuration of a frit-sealing apparatus for a cathode-ray tube according to a first embodiment of the present invention.
Figure 2:
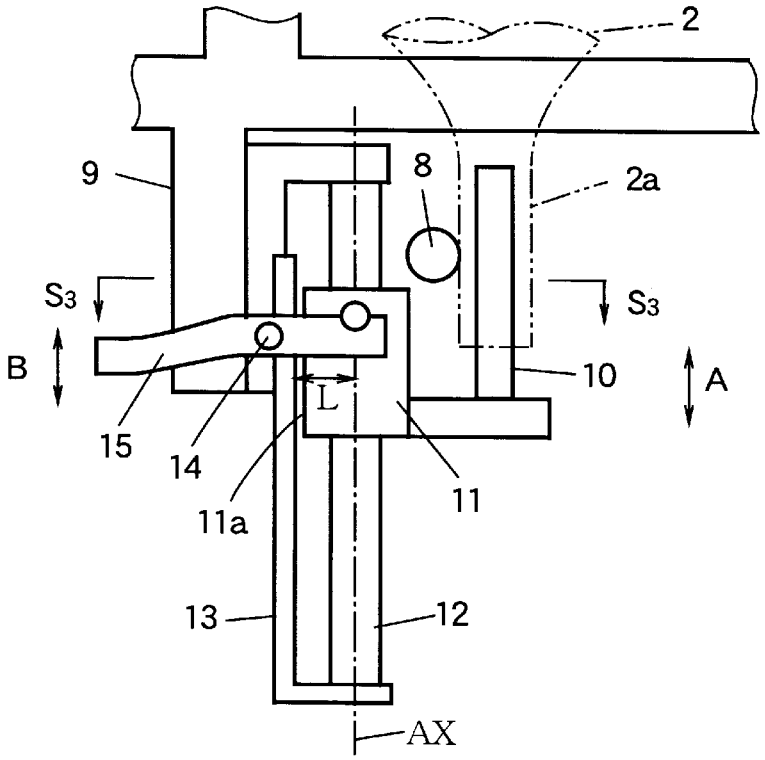
FIG. 2 is an enlarged schematic illustration of the configuration of a part of the frit-sealing apparatus shown in FIG. 1.
Figure 3:
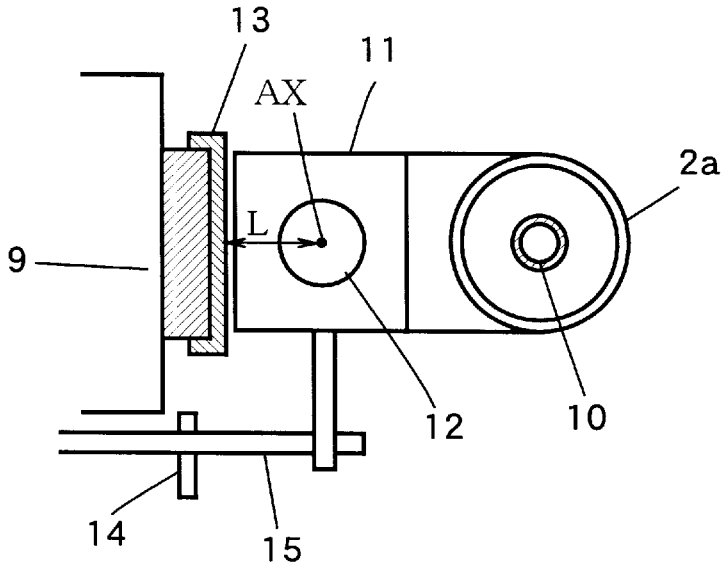
FIG. 3 is a schematic sectional illustration taken along the line $S_3$—$S_3$ of FIG. 2.

FIG. 1 is a schematic illustration of the configuration of a frit-sealing apparatus for a cathode-ray tube according to a first embodiment of the present invention, FIG. 2 is an enlarged schematic illustration of the configuration of a part of the frit-sealing apparatus shown in FIG. 1, and FIG. 3 is a sectional schematic illustration taken along the line $S_3$—$S_3$ of FIG. 2.

As shown in FIG. 1 or FIG. 2, the frit-sealing apparatus according to the first embodiment has the supporting members 4, 5, 6, 7, and 8 that are formed on the main body 9 to support and position with high precision a cathode-ray tube 3 including a panel 1 and a funnel 2. The supporting members 4, 5, and 6 support the panel 1 and the funnel 2 each at three points. The frit-sealing apparatus according to the first embodiment has a nozzle portion 10 that is inserted into and withdrawn from the cathode-ray tube 3, supported by the supporting members 4, 5, 6, 7, and 8, and a guide block 11 that supports the nozzle portion 10. The nozzle portion 10 is inserted into the cathode-ray tube 3 and lets air flow back from the cathode-ray tube 3 when the panel 1 and the funnel 2 are joined by fusing frit glass in the frit seal furnace (not shown).

The frit-sealing apparatus according to the first embodiment further has a guide rod 12 that is disposed on the main body 9 to support the guide block 11 so that it can slide in the directions, in which the nozzle portion 10 is inserted and withdrawn (directions A shown in the figure), and a guiding board 13 that is disposed on the main body 9 to function as a rotation restriction member for limiting the rotation of the guide block 11 on the guide rod 12, in contact with an end portion of the outer surface 11*a* of the guide block 11. In FIG. 2, there is a small clearance between the outer surface 11*a* of the guide block 11 and the guiding board 13. The outer surface 11*a* of the guide block 11 may be in light contact with the guiding board 13 in such a manner that the guide block 11 can slide.

As shown in FIG. 2 and FIG. 3, the frit-sealing apparatus according to the first embodiment has a swivel arm 15 that swivels on the supporting shaft 14 so as to slide the guide block 11 along the guide rod 12 in the directions A and a drive mechanism (not shown) that swivels the swivel arm 15 in the directions B.

The main body 9 that supports the cathode-ray tube 3 is carried on the mesh belt of a carrying conveyor (not shown), for example, and travels through the frit seal furnace. While the main body 9 is in the frit seal furnace, the nozzle portion 10 is inserted into the cathode-ray tube 3 by the guide block 11 that slides as the swivel arm 15 swivels. The nozzle portion 10 is withdrawn from the cathode-ray tube 3 by the guide block 11 that slides as the swivel arm 15 swivels when the main body 9 reaches the exit of the frit seal furnace.

As has been described above, the frit-sealing apparatus, according to the first embodiment, can suppress the horizontal movement of the nozzle portion 10 provided on the guide block 11 by means of the guiding board 13 that restricts the rotation of the guide block 11 on the guide rod 12 making contact with the end portion of the outer surface 11*a* of the guide block 11. When the nozzle portion 10 is inserted into or withdrawn from the cathode-ray tube 3, the nozzle portion 10 will not touch the neck portion 2*a* of the funnel 2 and damage the cathode-ray tube 3.

Figure 13:
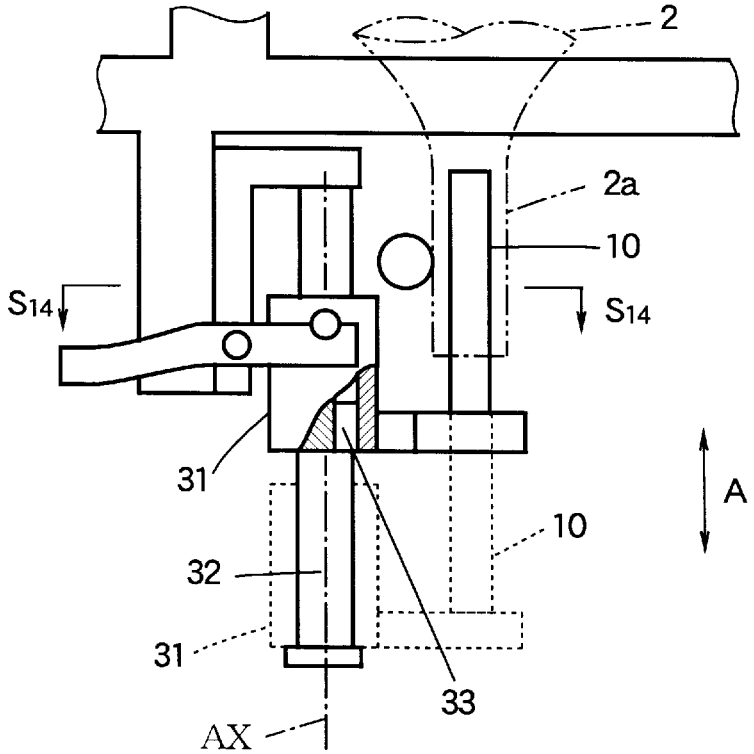
FIG.13 CONVENTIONAL ART
FIG. 13 is a schematic illustration of the configuration of the conventional frit-sealing apparatus to be placed in a frit seal furnace (not shown), with some parts taken away.
Figure 14:
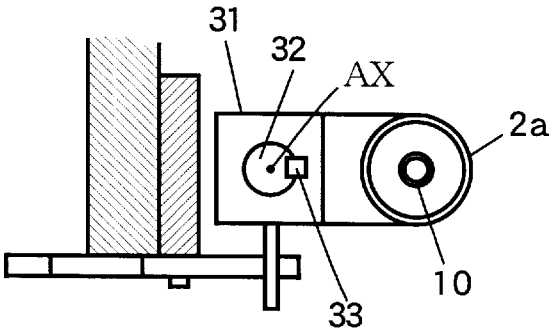
FIG.14 CONVENTIONAL ART
FIG. 14 is a sectional view taken along the line $S_{14}$—$S_{14}$ of FIG. 13.

The frit-sealing apparatus, according to the first embodiment, differs from the conventional frit-sealing apparatus in that the rotation of the guide block is not restricted by sliding a small key member along a narrow keyway on the guide rod. A mechanism for restricting the rotation of the guide block 11 is provided outside the guide block 11, where few size constraints are placed. Therefore, in the first embodiment, the distance from the axis AX of the guide rod to the position of rotation restriction (distance L in FIG. 2) can be increased. This distance L, in the first embodiment, corresponds to the distance from the axis AX to the position where the key member 33 comes in contact with the keyway of the guide block 31 in the conventional frit-sealing apparatus, as indicated in FIG. 13 and FIG. 14. Even when a clearance of the same distance is provided between the rotation restriction member (guiding board 13 in the first embodiment, shown in FIG. 2, and the key member 33 in the conventional frit-sealing apparatus, shown in FIG. 13 and FIG. 14) and the guide block (outer surface 11*a* in the first embodiment, and the keyway on the guide block 31 in the conventional apparatus, shown in FIG. 13 and FIG. 14), the error in angular displacement about the axis AX can be reduced in the first embodiment. Accordingly, the first embodiment can accomplish the same angular precision as the conventional frit-sealing apparatus by providing greater clearance between the rotation restriction member and the guide block. This increases the resistance to thermal deformation and foreign substance, decreasing the frequency of occurrence of the problem of small mechanisms such as the conventional keyway and key member being jammed because of thermal expansion or foreign substance.

Second Embodiment

Figure 4:
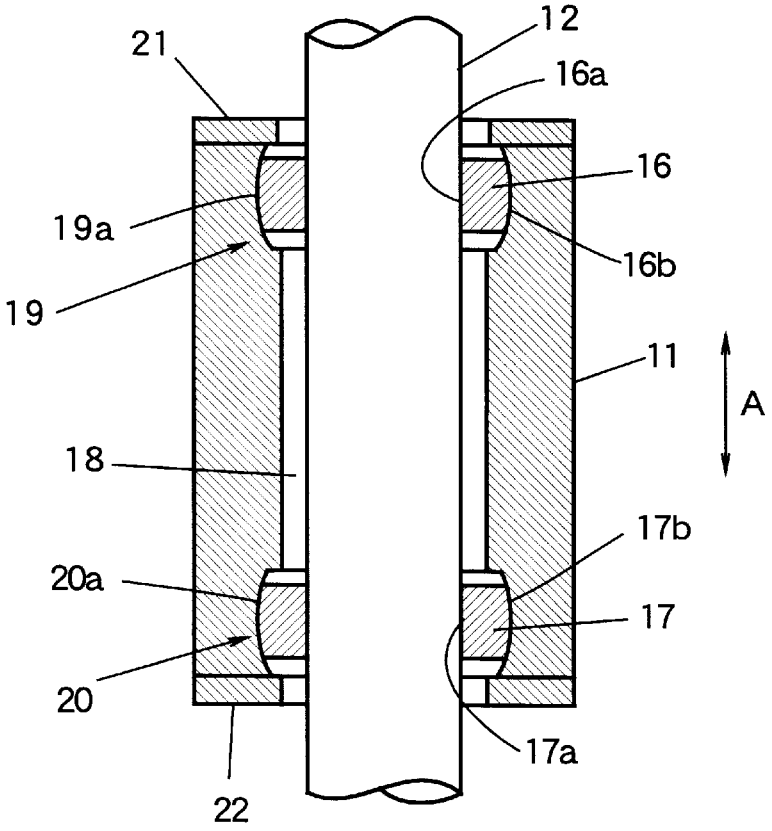
FIG. 4 is a longitudinal sectional schematic illustration of the configuration of the guide block and guide rod of a frit-sealing apparatus for a cathode-ray tube according to a second embodiment of the present invention.
Figure 5A:
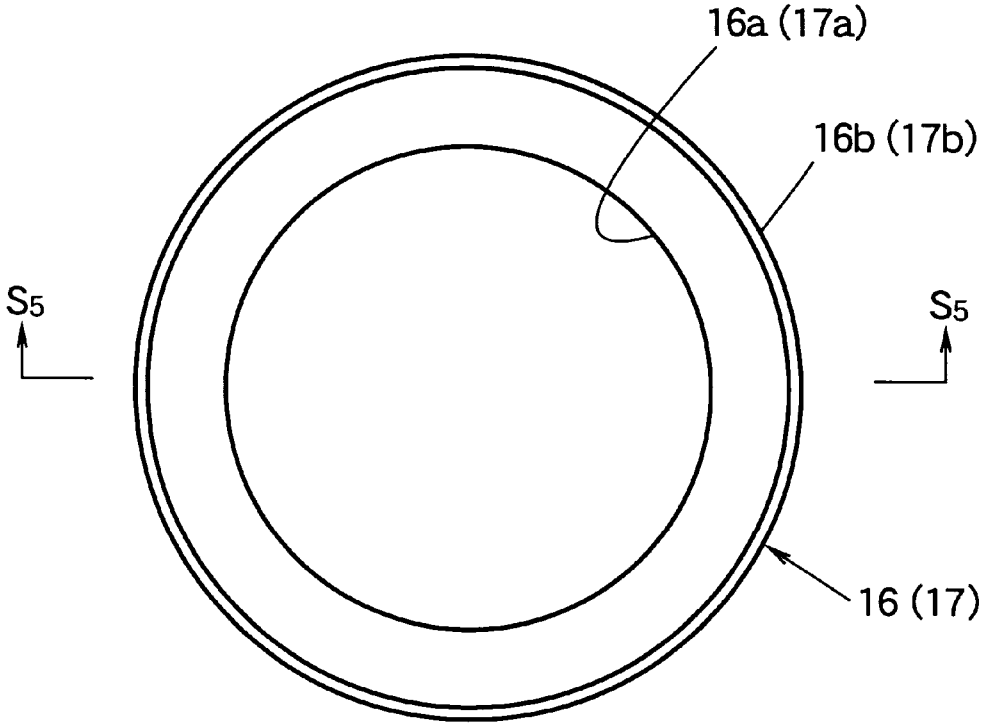
FIG. 5A is a plan view of an annular member in the second embodiment.
Figure 5B:
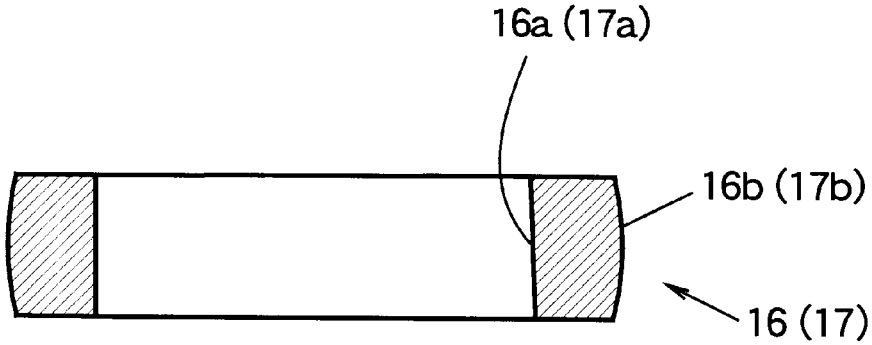
FIG. 5B is a sectional view taken along the line $S_5$—$S_5$ of FIG. 5A.
Figure 6A:
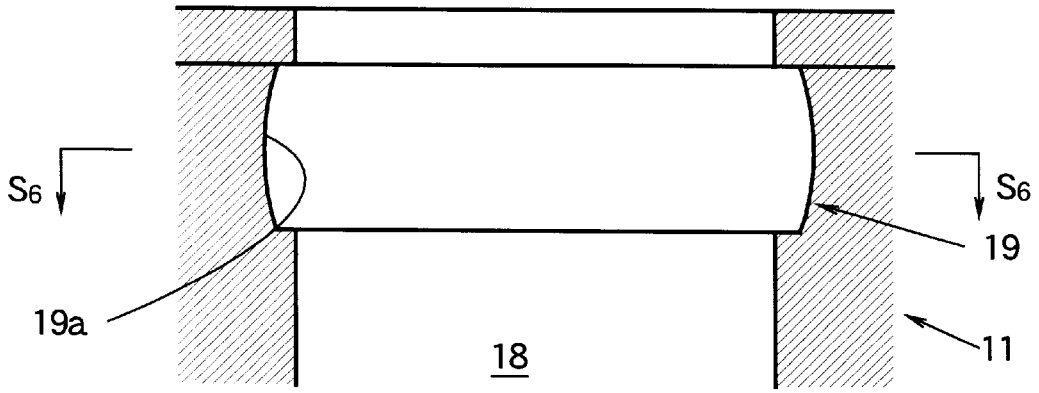
FIG. 6A is a longitudinal sectional view of the bearing portion of the guide block in the second embodiment.

FIG. 4 is a longitudinal sectional schematic illustration of the configuration of the guide block and guide rod of a frit-sealing apparatus for a cathode-ray tube according to a second embodiment of the present invention. FIG. 5A is a plan view of the annular member in the second embodiment, and FIG. 5B is a sectional view taken along the line $S_5$—$S_5$ of FIG. 5A. FIG. 6A is a longitudinal sectional illustration of the bearing portion of the guide block in the second embodiment, and FIG. 6B is a sectional view taken along the line $S_6$—$S_6$ of FIG. 6A.

The frit-sealing apparatus of the second embodiment differs from that of the first embodiment described above only in that an annular member and a bearing portion provided between the guide block 11 and guide rod 12 have an automatic alignment function. Accordingly, the second embodiment is described with reference to FIG. 1 to FIG. 3 as well as FIGS. 4A and 4B, FIGS. 5A and 5B, and FIGS. 6A and 6B. In FIGS. 4A and 4B, FIGS. 5A and 5B, and FIGS. 6A and 6B, the members identical or equivalent to the members in FIG. 1 to FIG. 3 are assigned identical reference symbols.

As shown in FIG. 4, FIGS. 5A and 5B, and FIGS. 6A and 6B, the frit-sealing apparatus, according to the second embodiment, has the first annular member 16 and second annular member 17, which are made of ceramic or other materials, for instance. The first annular member 16 has the form of a ring with the inner surface 16*a* in contact with the guide rod 12 and the outer surface 16*b* having the form of a part of a spherical surface. The second annular member 17 has the form of a ring with the inner surface 17*a* in contact with the guide rod 12 and the outer surface 17*b* having the form of a part of a spherical surface.

Figure 6B:
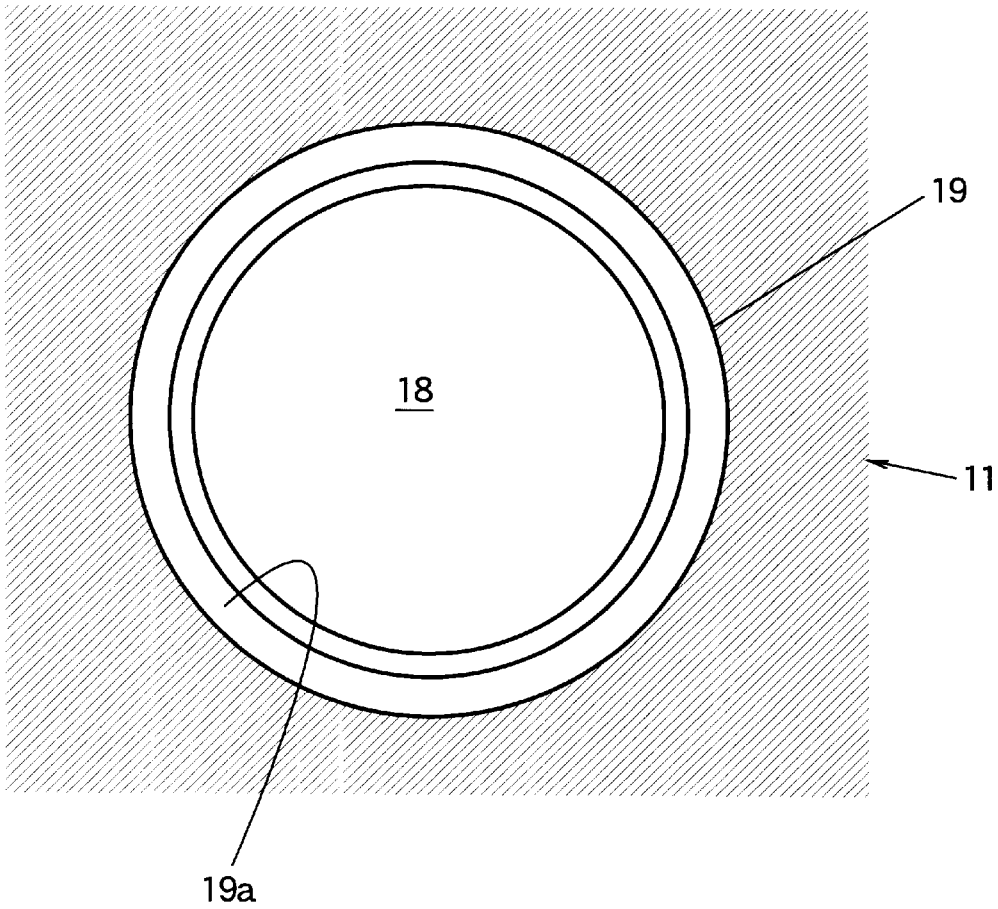
FIG. 6B is a sectional view taken along the line $S_6$—$S_6$ of FIG. 6A.

As shown in FIG. 4 or FIGS. 6A and 6B, the guide block 11 of the second embodiment has the through hole 18 through, which the guide rod 12 passes, the first bearing portion 19, and the second bearing portion 20. The first bearing portion 19 is disposed in the through hole 18 in the vicinity of the upper end and has the concave surface 19*a* of which curvature is equal to the curvature of the outer surface 16*b* of the first annular member 16. The second bearing portion 20 is disposed in the through hole 18 in the vicinity of the lower end and has the concave surface 20*a* of which curvature is equal to the curvature of the outer surface 17*b* of the second annular member 17. The guide rod 12 supports the guide block 11 by means of its outer surface in contact with the inner surfaces 16*a* and 17*a* of the first annular member 16 and second annular member 17.

Figure 7:
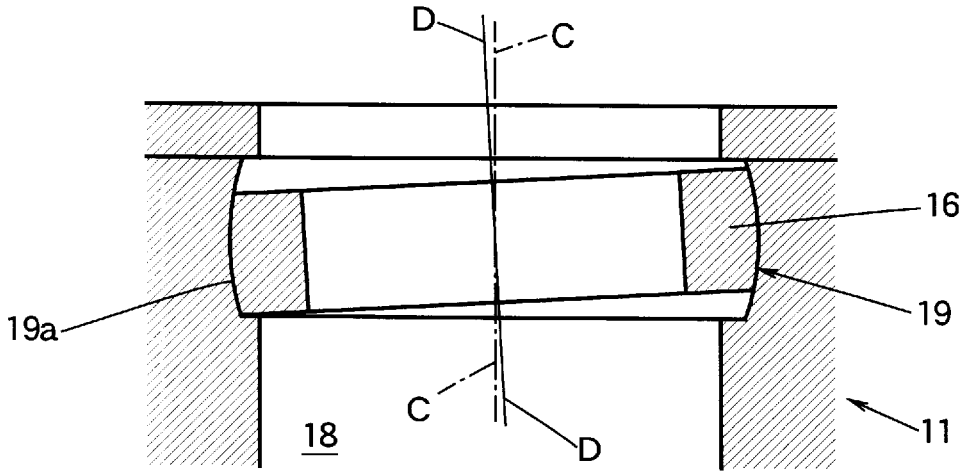
FIG. 7 is a sectional view of the first annular member tilted in the first bearing portion in the second embodiment.

As shown in FIG. 4, the guide block 11 is supported so as to slide together with the first annular member 16 and the second annular member 17 along the guide rod 12 in the directions A. As shown in FIG. 7, the first annular member 16 is fitted to the first bearing portion 19 in such a manner that the central axis D—D of the first annular member 16 can be tilted in any direction from the central axis C—C of the through hole 18. The second annular member 17 is fitted to the second bearing portion 20 in such a manner that the central axis (not shown) of the second annular member 17 can be tilted in any direction from the central axis C—C of the through hole 18. Reference symbols 21 and 22 in FIG. 4 indicate plate covers fastened to the outside of the first bearing portion 19 and the second bearing portion 20 of the guide block 11.

Figure 8:
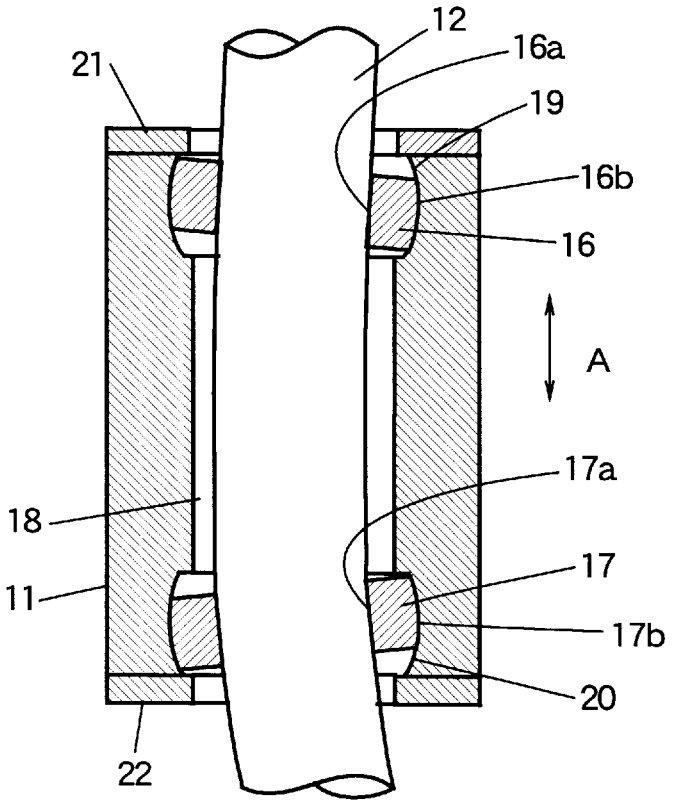
FIG. 8 is a longitudinal sectional schematic illustration of the warped guide rod of the frit-sealing apparatus in the second embodiment.

FIG. 8 is a longitudinal sectional schematic illustration of the warped guide rod 12 in the frit-sealing apparatus for a cathode-ray tube according to the second embodiment. As shown in FIG. 8, when the guide rod 12 is warped, the first annular member 16 and the second annular member 17 can be tilted in the first bearing portion 19 and the second bearing portion 20 in agreement with the degree of warp of the guide rod 12. Accordingly, even when the guide rod 12 is warped because of thermal expansion, the guide block 11 can slide along the guide rod 12, reducing the frequency of occurrence of the problem of the nozzle portion 10 being unable to withdraw.

Third Embodiment

Figure 9:
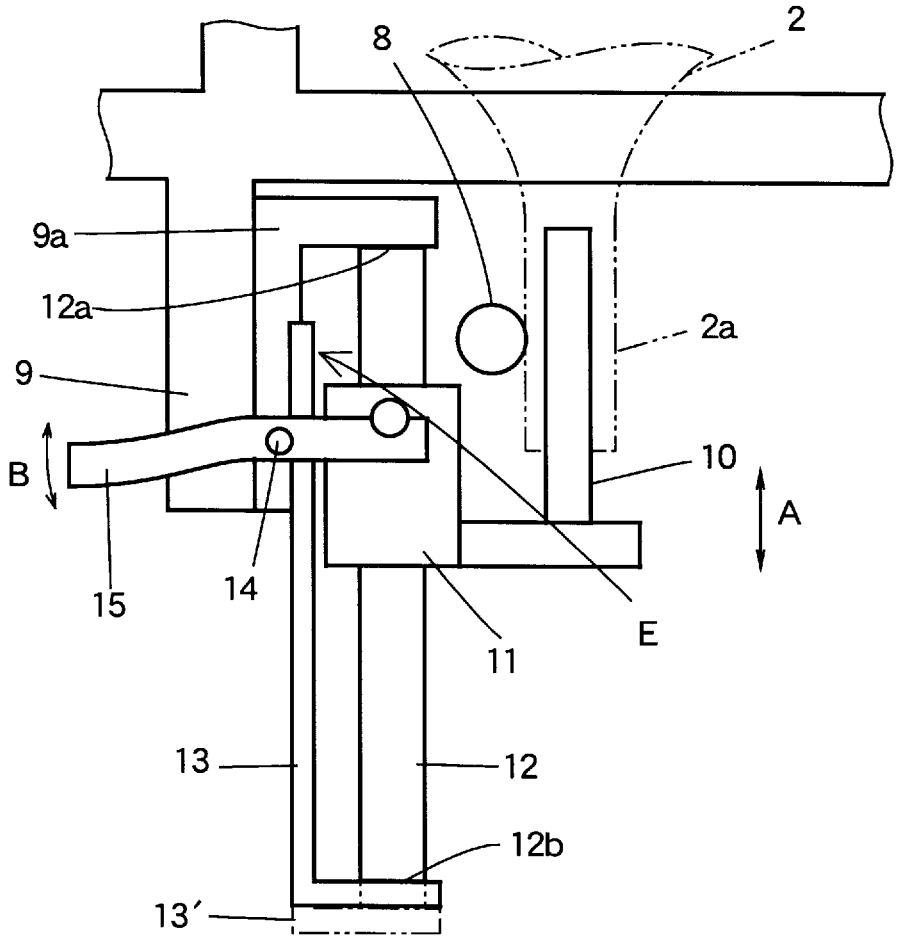
FIG. 9 is a schematic illustration of the configuration of a frit-sealing apparatus for a cathode-ray tube of a third embodiment of the present invention.
Figure 10:
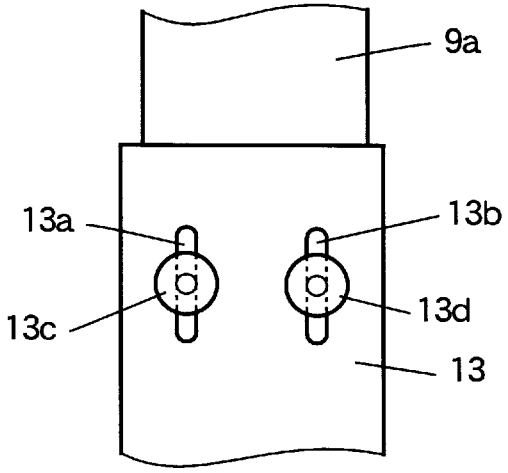
FIG. 10 is an enlarged view of the section E of FIG. 9, viewed from the right-hand part of FIG. 9.

FIG. 9 is a schematic illustration of the configuration of a frit-sealing apparatus for a cathode-ray tube according to a third embodiment of the present invention. FIG. 10 is an enlarged view of the section E of FIG. 9, viewed from the right-hand part of FIG. 9.

The frit-sealing apparatus of the third embodiment differs from that of the first embodiment, described above, only in that the guiding board 13 is provided on the main body 9 so as to slide in the directions A. The third embodiment is described with reference to FIG. 1 to FIG. 3 as well as FIG. 9 and FIG. 10. In FIG. 9, the members identical or equivalent to the members shown in FIG. 1 to FIG. 3 are assigned identical reference symbols.

In the frit-sealing apparatus according to the third embodiment, the end portion 12*a* of the guide rod 12, which is closer to the cathode-ray tube 3, is fastened to the main body 9, and the other end portion 12*b* of the guide rod 12, which is far from the cathode-ray tube 3, is fastened to the end portion of the guide member 13. The guide member 13 is mounted so that it can slide from the position indicated by the solid line in FIG. 9 to the position 13' indicated by the chain line.

The guide member 13 can be mounted on the main body 9, for example, by providing the guiding board 13 having a U-shaped cross section so as to slide along the guide member 9*a* fixed on the main body 9, as shown in FIG. 3, and so as not to be disengaged from the guide member 9*a*, as shown in FIG. 10. The mechanism that prevents the guiding board 13 from being disengaged from the guide member 9*a* can be established, for example, by providing the narrow openings 13*a* and 13*b* on the guiding board 13, as shown in FIG. 10, and threading the screws 13*c* and 13*d* through the narrow opening 13*a* and 13*b* into the guide member 9*a*. This mechanism allows the guiding board 13 to slide along the guide member 9*a*. The method of providing the guiding board 13 to slide along the guide member 9*a* is not limited to the method described above.

As has been described above, the frit-sealing apparatus according to the third embodiment is structured so that when the guide rod 12 is lengthened due to thermal expansion, the guide member 13 slides to protect the guide rod 12 from the load of compression. This makes the guide rod 12 hard to warp due to thermal expansion. Accordingly, the frequency of occurrence of the problem of the nozzle portion 10 being unable to withdraw after frit-sealing can be reduced.

In the description above, the structure of FIG. 9 has been applied to the first embodiment, but the structure may also be applied to the second embodiment.

Fourth Embodiment

Figure 11:
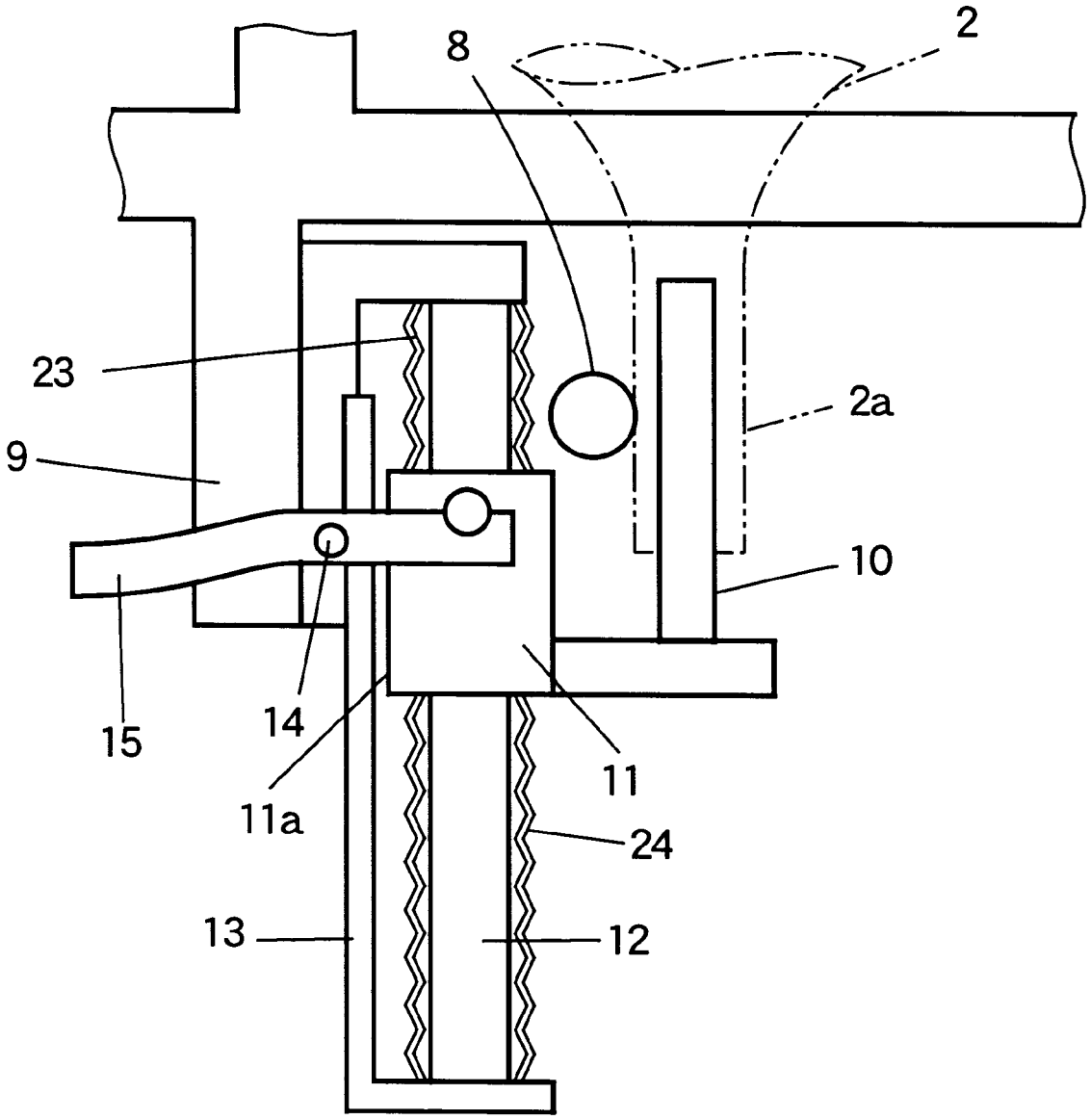
FIG. 11 is a schematic illustration of the configuration of a frit-sealing apparatus for a cathode-ray tube of a fourth embodiment of the present invention.
Figure 12:
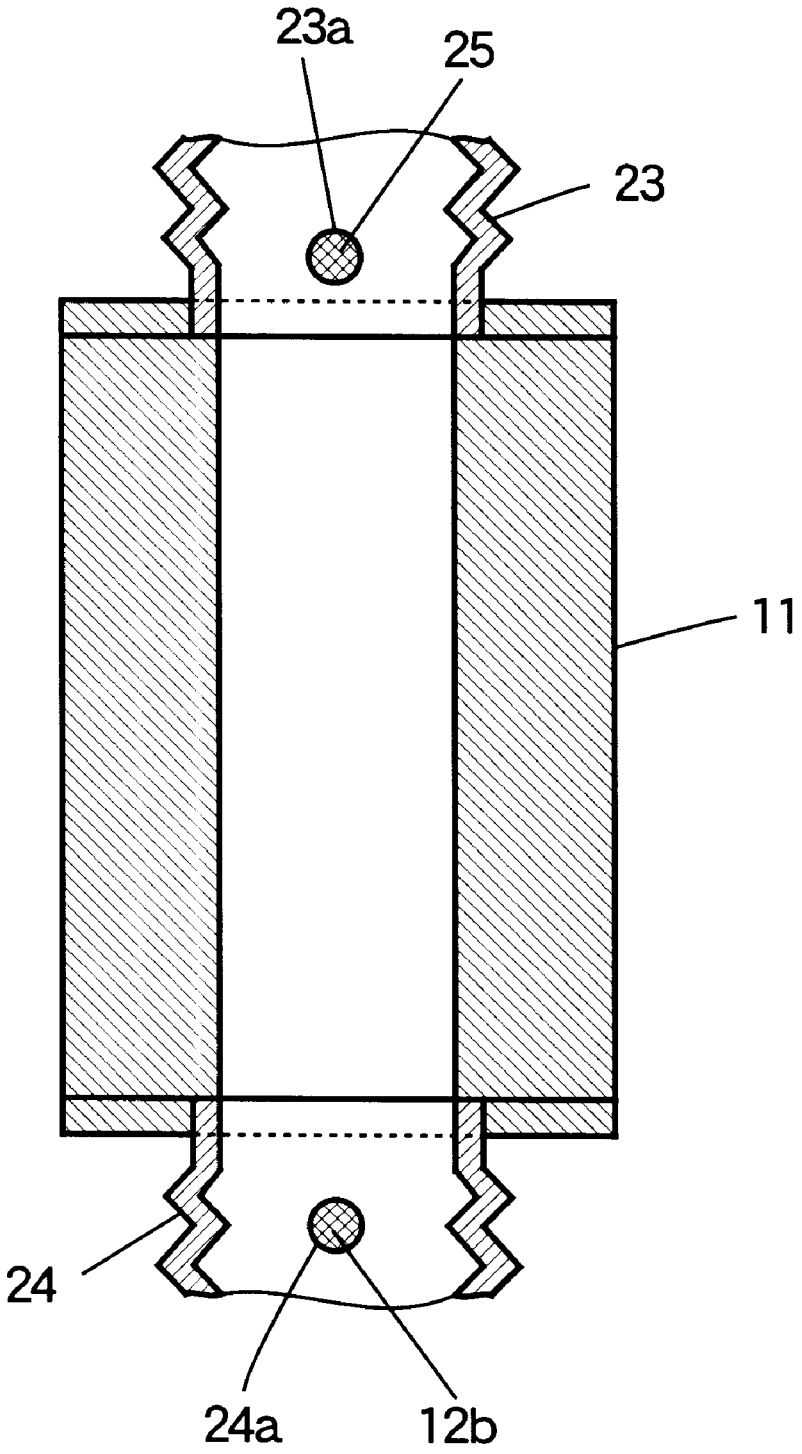
FIG. 12 is an enlarged longitudinal sectional schematic illustration of a part of the frit-sealing apparatus shown in FIG. 11.

FIG. 11 is a schematic illustration of the configuration of a frit-sealing apparatus for a cathode-ray tube according to a fourth embodiment of the present invention. FIG. 12 is an enlarged longitudinal sectional schematic illustration of a part of the frit-sealing apparatus shown in FIG. 11.

The frit-sealing apparatus of the fourth embodiment differs from that of the first embodiment described above only in that the bellows-shaped extensible covers 23 and 24 are provided to separate the area around the guide rod 12 from the external atmosphere within the frit seal furnace. The fourth embodiment is described with reference to FIG. 1 to FIG. 3 as well as FIG. 11 and FIG. 12. In FIG. 11 and FIG. 12, the members identical or equivalent to the members shown in FIG. 1 to FIG. 3 are assigned identical reference symbols.

As shown in FIG. 11 or FIG. 12, the frit-sealing apparatus according to the fourth embodiment has the bellows-shaped covers 23 and 24 that isolate the area around the guide rod 12 from the external atmosphere within the frit seal furnace. The covers 23 and 24 are made of metal, for example, but may be made of other materials. The metals used to form the covers 23 and 24 include stainless steel and aluminum. In comparison with stainless steel, aluminum is more desirable for endurance because it has greater ductility.

As shown in FIG. 12, the covers 23 and 24 have holes 23*a* and 24*a* for letting air pass through, in which the mesh sheets 25 and 26 or other filters are provided to prevent foreign substances from entering the covers 23 and 24 through the holes 23*a* and 24*a*.

As has been described above, the frit-sealing apparatus according to the fourth embodiment covers the area around the guide rod 12 with its covers 23 and 24 and allows air to go into and come out of the covers 23 and 24 through the mesh sheets 25 and 26. This prevents rust, soot, and other foreign substances from entering the clearance between the guide block 11 and the guide rod 12. Accordingly, the frequency of occurrence of the problem of the nozzle portion 10 being unable to withdraw can be reduced.

In the explanation above, the covers 23 and 24 of FIG. 11 have been applied to the first embodiment. The covers may also be applied to the second or third embodiment or the frit-sealing apparatus for a cathode-ray tube shown in FIG. 13.

The invention being thus described, it will be obvious that the same may be varied in many ways. Such variations are not to be regarded as a departure from the spirit and scope of the invention, and all such modifications as would be obvious to one skilled in the art are intended to be included within the scope of following claims.

What is claimed is:

1. A frit-sealing apparatus for a cathode-ray tube, comprising:

a main body adapted to support the cathode-ray tube in a certain position;

a nozzle portion adapted to be inserted into and withdrawn from the cathode-ray tube supported in the certain position;

a guide block for supporting said nozzle portion;

a guide rod supported by said main body and supporting said guide block so as to slide in directions in which said nozzle portion is inserted and withdrawn; and a rotation restriction member in contact with an outer surface of said guide block, thereby restricting rotation of said guide block, said rotation restriction member being formed independent from said main body.

2. A frit-sealing apparatus for a cathode-ray tube comprising:

a main body adapted to support the cathode-ray tube in a certain position;

a nozzle portion adapted to be inserted into and withdrawn from the cathode-ray tube supported in the certain position;

a guide block for supporting said nozzle portion;

a guide rod supported by said main body and supporting said guide block so as to slide in directions in which said nozzle portion is inserted and withdrawn; and a rotation restriction member in contact with an outer surface of said guide block, thereby restricting rotation of said guide block, wherein an end portion of said guide rod, closer to the cathode-ray tube, is secured to said main body of the frit-sealing apparatus, another end portion of said guide rod far from the cathode-ray tube is secured to said rotation restriction member, and said rotation restriction member is provided to slide in the directions of insertion and withdrawal.

3. A frit-sealing apparatus for a cathode-ray tube of claim 1, further comprising:

a first annular member having a shape of a ring with a first inner surface, which is in contact with said guide rod, and a first outer surface, which has a form of a part of a spherical surface; and a second annular member, which has a shape of a ring with a second inner surface in contact with said guide rod, and a second outer surface, which has a form of a part of a spherical surface;

wherein said guide block has a through hole through which said guide rod passes, a first bearing portion, which has a first concave surface having the same curvature as the first outer surface of said first annular member provided in said through hole, and a second bearing portion, which has a second concave surface having the same curvature as the second outer surface of said second annular member, provided in said through hole; and wherein said first annular member is fitted to said first bearing portion in such a way that a central axis of said first annular member is able to be tilted from the central axis of said through hole, said second annular member is fitted to said second bearing portion in such a way that a central axis of said second annular member is able to be tilted from the central axis of said through hole, and said guide block and said nozzle portion are structured to slide along said guide rod by sliding said first inner surface of said first annular member and said second inner surface of said second annular member along said guide rod.

4. A frit-sealing apparatus for a cathode-ray tube of claim 1, further comprising:

a cover, having an extensible characteristic, for isolating said guide rod from external atmosphere.

5. A frit-sealing apparatus for a cathode-ray tube of claim 4, wherein said cover has a metallic bellows structure.

6. A frit-sealing apparatus for a cathode-ray tube of claim 4, wherein said cover includes, a hole through which air passes, and a filter provided in said hole for preventing foreign substances from entering through said hole.

7. A frit-sealing apparatus for a cathode-ray tube, comprising:

a nozzle portion being inserted into and withdrawn later from the cathode-ray tube supported in a certain position;

a guide block for supporting said nozzle portion;

a guide rod for supporting said guide block so as to slide in directions in which said nozzle portion is inserted and withdrawn;

a cover, having an extensible characteristic, for isolating said guide rod from external atmosphere;

a chamber formed between the guide rod and the cover; and a vent in the cover for venting the chamber.

8. A frit-sealing apparatus for a cathode-ray tube of claim 7, wherein said cover comprises a metallic bellows structure.

9. A frit-sealing apparatus for a cathode-ray tube of claim 7, wherein said cover includes, a hole through which air passes, and a filter provided in said hole for preventing foreign substances from entering through said hole.

10. A frit-sealing apparatus for a cathode-ray tube of claim 1, wherein at least upper and lower end portion of said rotation restriction member is attached to said main body.

11. A frit-sealing apparatus for a cathode-ray tube, comprising:

a nozzle portion being inserted into and withdrawn later from the cathode-ray tube supported in a certain position;

a guide block for supporting said nozzle portion;

a guide rod for supporting said guide block so as to slide in directions in which said nozzle portion is inserted and withdrawn; and a cover, having an extensible characteristic, for isolating said guide rod from external atmosphere, the cover including a first portion that covers a portion of said guide rod above said guide block, and a second portion that covers a portion of said guide rod below said guide block.

* * * * *